US006689944B1

(12) United States Patent
Okumura

(10) Patent No.: US 6,689,944 B1
(45) **Date of Patent: *Feb. 10, 2004**

(54) DRUM ACOUSTIC WIRE AND DRUM

(75) Inventor: Yukimasa Okumura, Hamamatsu (JP)

(73) Assignee: Yamaha Corporation, Shizuoka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/546,967

(22) Filed: Apr. 11, 2000

(30) Foreign Application Priority Data

Apr. 12, 1999 (JP) ..... 11-103733

(51) Int. Cl.[7] ..... G10D 3/02
(52) U.S. Cl. ..... 84/411 R; 84/415; 84/416
(58) Field of Search ..... 84/417, 418, 419, 84/415, 416, 411 R

(56) References Cited

U.S. PATENT DOCUMENTS

| | | | | | |
|---|---|---|---|---|---|
| 4,095,505 | A | * | 6/1978 | Hoey et al. | 84/416 |
| 4,787,286 | A | * | 11/1988 | Okumura | 84/417 |
| 5,204,484 | A | * | 4/1993 | Netto | 84/415 |
| 5,684,257 | A | * | 11/1997 | Yanagisawa | 84/415 |
| 5,844,157 | A | * | 12/1998 | Kasha | 84/415 |
| 5,895,873 | A | * | 4/1999 | Yanaagisawa | 84/415 |
| 6,008,445 | A | * | 12/1999 | Chen | 84/415 |
| 6,091,010 | A | * | 7/2000 | Gauger | 84/415 |
| 6,093,877 | A | * | 7/2000 | Nickel | 84/415 |

FOREIGN PATENT DOCUMENTS

| | | | | |
|---|---|---|---|---|
| DE | 43057 | * | 4/1888 | 84/415 |
| DE | 3807466 | * | 9/1989 | G10D/13/02 |
| JP | S58-50372 B | | 11/1983 | |
| RU | 02005317 | * | 12/1993 | 84/421 |

* cited by examiner

*Primary Examiner*—Kimberly Lockett
(74) *Attorney, Agent, or Firm*—Koda & Androlia

(57) ABSTRACT

An acoustic wire for a drum comprising a single long wire made of metal, resin, etc. and strung in a plurality of turns between a pair of supporting members. The single long wire in the form of a plurality of parallel acoustic wires comes into contact with the drum head when the supporting members are moved toward the drum head. The acoustic wire provides a long attenuation time of the vibration of the acoustic wire and large quantity of sound.

15 Claims, 5 Drawing Sheets

DRUM ACOUSTIC WIRE AND DRUM

BACKGROUND OF THE INVENTION

1. Field of the Invention

The present invention relates to a drum acoustic wire used in drums such as concert snare drums, marching drums, bass drums and tom toms and further to a drum that uses such an acoustic wire.

2. Prior Art

Generally, drums known as snare drums have a drum acoustic wire that is mounted on the drum head of the non-percussion surface side, i.e., on the underside or bottom drum head. There are drums in which acoustic wires are mounted on both the drum heads on the percussion surface side (top side) and on the non-percussion surface side. Furthermore, in some drums, an acoustic wire is mounted only on the drum head on the percussion surface side. These types of drums are also called snare drums.

FIG. 7 shows a typical conventional snare drum.

In this snare drum 1, a drum acoustic wire 3 is provided so as to be selectively brought into contact with and moved away from the under side drum head 2 by means of a drawing mechanism 4. The vibration of the under side drum head 2 is transmitted to the drum acoustic wire 3, thus providing a special acoustic effect known as a "tabling" effect, which endows the musical instrument with a peculiar lively "pattering" tone color.

This type of snare drum is disclosed in, for instance, Japanese Utility Model Application Laid-Open (Kokai) No. H58-50372. In this prior art, eight wires are employed. One end of each wire is formed with a ball, and another end thereof is attached with an adjustment screw. The wires are installed between the snap plate and the adjustment screw base.

The drum acoustic wire 3 of FIG. 7 comprises a plurality of fine acoustic wires 3*a* through 3*n*. As shown in FIGS. 8(*a*) and 8(*b*), these acoustic wires 3*a* through 3*n* are installed side by side with an appropriate spacing in between in the direction perpendicular to the axial line of each wire, and they are strung between a pair of supporting members 5*a* and 5*b*.

In FIG. 8(*a*), the end portions of the acoustic wires 3*a* through 3*n* are respectively fastened to the respective supporting members 5*a* and 5*b* by soldering, etc. In FIG. 8(*b*), one end of each of the acoustic wires 3*a* through 3*n* is fastened to one of the supporting members 5*a*, while another end of each acoustic wire is connected to the other supporting member 5*b* so that the tension can be adjusted by an adjustment screw 6.

Known materials of drum acoustic wires 3 are fine steel wires wrapped in a coil form as shown in FIG. 8(*a*). Rectilinear wires formed from a synthetic resin such as Nylon (trademark), etc. as shown in FIG. 8(*b*) are also well known.

Coil-form steel wires make a point-contact with the drum head. Thus, such wires are extremely sensitive to external vibrations such as noise, and sound pressure and noise from bass amplifiers and guitar amplifiers, etc., thus they easily resonate. On the other hand, rectilinear wires make a line-contact with the drum head. Accordingly, such wires show little resonance with respect to external vibrations compared to coil-form steel wires. Rectilinear wires are not usually used for marching drums.

As described above, a conventional drum acoustic wire 3 is comprised of a plurality of acoustic wires 3*a* through 3*n* that consist of coil-form steel wires or rectilinear wires. These acoustic wires are fastened one at a time by soldering to the supporting members 5*a* and 5*b*, or they are fastened with adjustment screws 6 so that the tension can be adjusted. As a result, the attachment work of the acoustic wire is bothersome and requires a considerable amount of time. Also, it is difficult to uniformly adjust the tension on all the acoustic wires 3*a* through 3*n*. Moreover, since the lengths of the acoustic wires 3*a* through 3*n* cannot be made longer than the diameter of the drum, the vibration of the wires is suppressed, and the attenuation time is short.

SUMMARY OF THE INVENTION

The present invention is to solve the above-described conventional problems.

One object of the present invention is to provide a drum acoustic wire and drum in which an attachment of the wire to wire supporting members and an adjustment of the tension of the wire can be performed easily.

Another object of the present invention is to provide a drum acoustic wire and drum in which a uniform tension of the wire can be constantly obtained.

Still another object of the present invention is to provide a drum acoustic wire in which the attenuation time of the vibration of the acoustic wire can be long, and a large sound quantity can be obtained.

So as to accomplish the above objects, in the drum acoustic wire of the present invention, the drum acoustic wire that is alternately caused to contact and move away from a drum head is formed by a single long wire, and this single long wire is bent and strung in a plurality of turns between a pair of supporting members so that these acoustic wires form a single continuous strand.

Since the acoustic wire is a single continuous wire, the attenuation of the vibration of the acoustic wire is long, a large sound quantity can be obtained, and an acoustic effect differing from that of conventional acoustic wires can be obtained.

A coil-form or rectilinear metal wire, a wrapped wire for guitars, an aramide fiber wire (Kevlar wire), a synthetic resin wire consisting of nylon, and the like are used for the acoustic wire of the present invention.

In the present invention, the bent portions of the wire are supported by supporting members so that these bent portions can slide sideways.

In this structure, since only both ends of the wire are fastened to the supporting members, no excessive load is applied to the wires, and a free vibration can be obtained. Also, the tension on the respective turns of the wire are uniformly distributed.

Furthermore, in the present invention, the acoustic wire can be formed by a plurality of ring-form wires so that they are strung between a pair of supporting members.

In this structure, it is only necessary to install ring-form wires between the supporting members; and each ring-form wire forms two acoustic wires.

In addition, the acoustic wires of the present invention are used in association with an adjustment mechanism that adjusts the tension of the acoustic wires.

In this structure, the tension of all of the acoustic wires can be simultaneously and uniformly adjusted.

The present invention further provides a drum that is equipped with the drum acoustic wire as described above.

Such a drum has an acoustic effect that significantly differs from that of conventional drums.

DETAILED DESCRIPTION OF THE PREFERRED EMBODIMENTS

Figure 1:
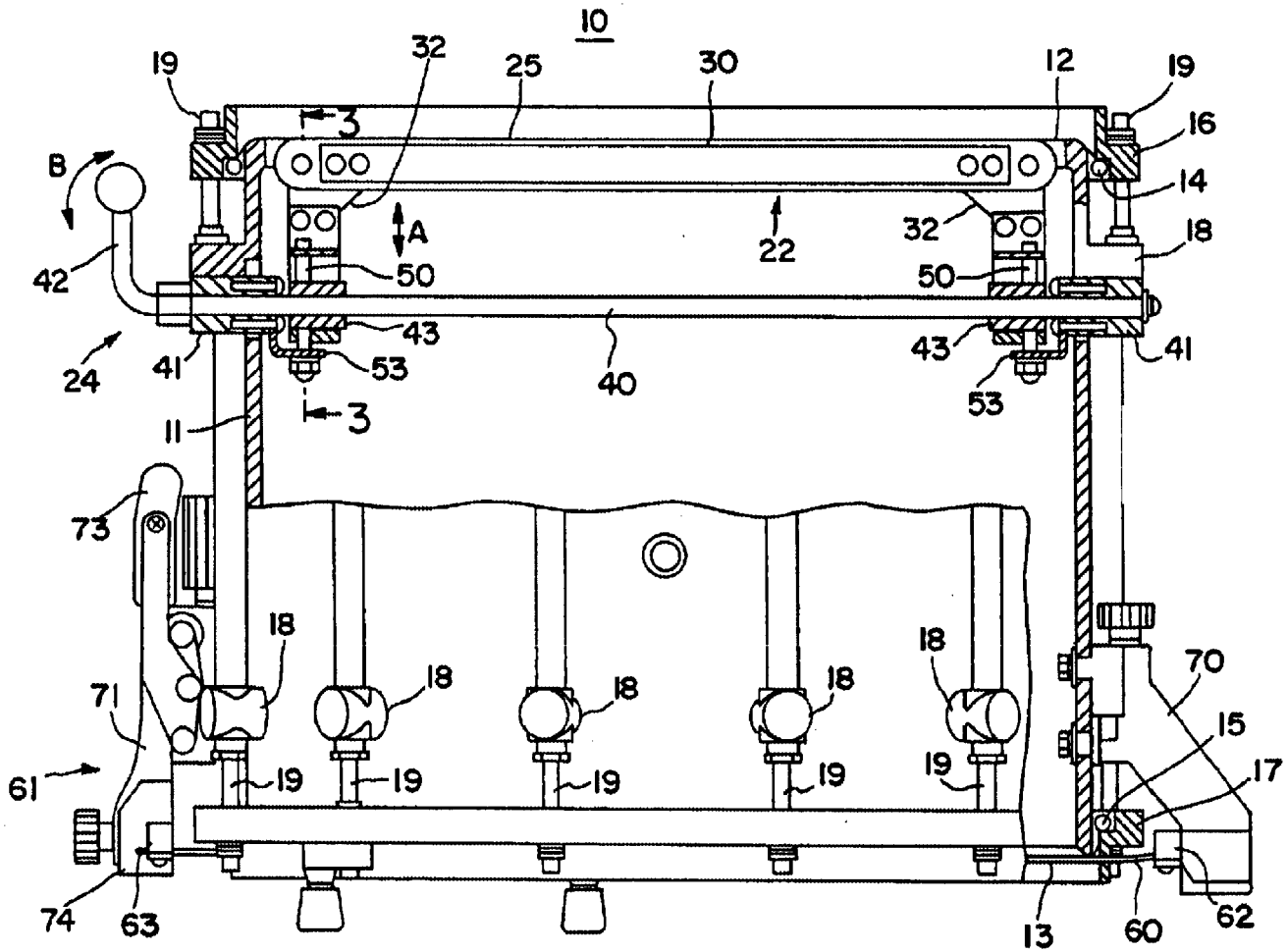
FIG. 1 is a partially cut-away front view of a marching snare drum equipped with the drum acoustic wire according to the present invention.

The present invention will be described below with reference to embodiments in which the acoustic wire are used in a marching snare drum.

The marching snare drum 10 used in the present invention comprises a relatively deep cylindrical trunk main body 11, and a top side (percussion surface side) drum head 12 and an under side (non-percussion surface side) drum head 13 are respectively stretched over the openings of this cylindrical trunk main body 11. These drum heads 12 and 13 are formed from a natural leather consisting of an animal skin, or from a synthetic resin film such as a polyester or polycarbonate, etc. The outer circumferential edge portions of the drum heads are respectively held by circular head frames 14 and 15.

The head frames 14 and 15 are mounted on the outer circumferences of the respective openings of the trunk main body 11, and tightening frames 16 and 17 are respectively engaged on the outer circumferences of the head frames 14 and 15. These tightening frames 16 and 17 are respectively connected by bolts 19 to a plurality of lugs 18 attached to the outer circumference of the trunk main body 11. Thus, the tension of the respective drum heads 12 and 13 can be adjusted by turning these bolts 19. When the bolts 19 are tightened and the tightening frames 16 and 17 are caused to shift toward the center of the trunk main body 11, the tightening frames 16 and 17 press the head frames 14 and 15 and cause the head frames 14 and 15 to move toward the center of the trunk main body 11. As a result, the tension of the drum heads 12 and 13 increases. When the bolts 19 are loosened, the tension decreases.

A first drum acoustic wire 22 is installed in the interior of the trunk main body 11. With a first drawing mechanism 24, the first drum acoustic wire 22 is brought so as to make a contact with the undersurface of the top side drum head 12, and it is also detached and moved away from the undersurface of the top side drum head 12 as shown by arrow A.

Figure 2:
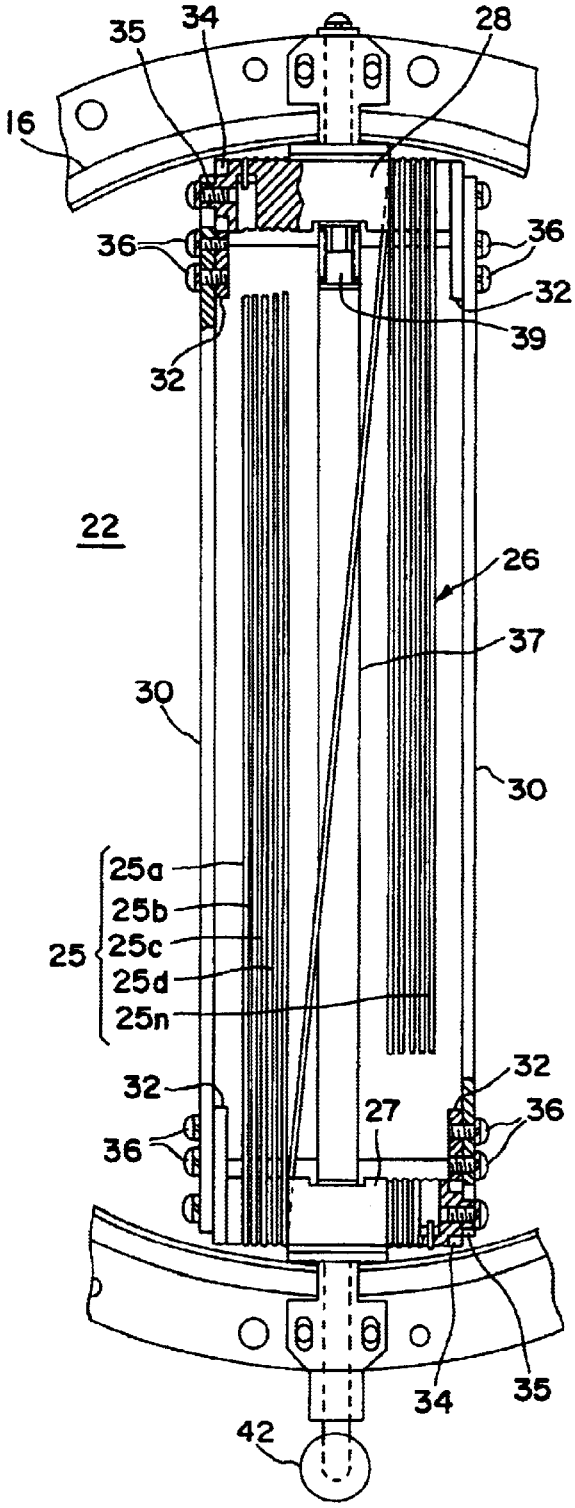
FIG. 2 is top view of the acoustic wire with some portions thereof being omitted.

As seen from FIG. 2, the first drum acoustic wire 22 is obtained from a plurality of fine acoustic wires 25 (25*a* through 25*n*). More specifically, these acoustic wires 25 are formed by repeatedly stringing a single long wire 26 between a pair of supporting members 27 and 28, which are round posts and are disposed on diametrically opposite sides of the cylindrical drum body 11, so that this long wire 26 forms a continuous strand. In other words, when the acoustic wires 25 are removed form the supporting member 27 and 28, it is the single long wire 26.

When stringing the wire 26, one end of the wire 26 is fastened to the supporting member 27 (or to the other supporting member 28); then, the intermediate portion of the wire 26 is alternately run approximately 180° around the circumferential surfaces of the two supporting members 27 and 28; and the other end of the wire 26 is fastened to the supporting member 28 (or to the other supporting member 27). Accordingly, the bent portions of the wire 26 that are run around the supporting members 27 and 28 are supported on the supporting members 27 and 28 so as to be slidable sideways. More specifically, the end portions of the two acoustic wires 25*a* and 25*n* (located on both sides), which are opposite from the fixed ends of the acoustic wires 25*a* and 25*n*, and the respective end portions of the acoustic wires 25*b* through 25*n*-1 are supported on the respective supporting members 27 and 28 so that these end or bent portions can slide sideways.

In this case, by stringing the wire 26 so that it is run half a turn at a time around the circumferential surfaces of the respective supporting members 27 and 28, the wire is strung (or it extends) above and below the supporting member 27 and 28. Thus, the portions of the wire on the upper side (of the supporting member 27 and 28) are used as the acoustic wires 25*a* through 25*n*; and the portions of the wire on the lower side (of the supporting member 27 and 28) function as excess-length portions of the acoustic wires 25*a* through 25*n*, and these lower side portions can resonate when the acoustic wires 25*a* through 25*n* vibrate.

In the above structure, when spiral grooves 29 are formed in the circumferential surfaces of the supporting members 27 and 28, the wire 26 is guided in these grooves and can be strung at a fixed spacing.

A rectilinear steel wire as stipulated in JIS (Japanese Industrial Standard) G3525, e.g., a wire with a diameter of approximately 0.6 to 2.0 mm as stipulated in JIS B72, is used as the wire 26. This wire is strung approximately 10 to 30 times at a fixed spacing (e.g., 2.9 mm) between the supporting members 27 and 28. The wire used in the present invention is limited to a steel wire. It can be a wrapped wire for a guitar, an aramide fiber wire (Kevlar wire), and a synthetic resin wire consisting of nylon, etc. Furthermore, the wire used in the present invention is not limited to a rectilinear wire, and a coil-form wire may also be used.

The above-described pair of supporting members 27 and 28 are installed between a pair of left and right side frames 30 via brackets 32. The brackets 32 are fastened between the end parts of the side frames 30 by a plurality of screws 36. The brackets 32 are formed with slots 34 that extend in the direction of length of the side frames 30 formed in the upper end portions thereof. Furthermore, slots 35 are also formed in the end portions of the respective side frames 30 so that they correspond to the slots 34. The end portions of the respective supporting members 27 and 28 are slidably supported by these slots 34 and 35.

Furthermore, the central portions of the pair of supporting members 27 and 28 (with respect to the direction of length of the supporting members) are connected to each other by a rod 37 which forms a tension adjustment mechanism. Externally threaded screws 39 are formed on both ends of this rod 37, and these externally threaded screws 39 are engaged with screw holes formed in the respective supporting members 27 and 28. Thus, when the rod 37 is rotated, the supporting members 27 and 28 are caused to approach each other and move away from each other, so that the tension of the acoustic wires 25*a* through 25*n* can be adjusted. In this case, since the acoustic wires 25*a* through 25*n* is a single continuous strand, and since the bent portions are supported by being strung around the supporting members 27 and 28 so that the bent portions are slidable, all of the acoustic wires 25*a* through 25*n* can be adjusted to a uniform tension.

In the typical embodiment, the diameters of the supporting members 27 and 28 are approximately 6 to 50 mm. It is also possible to wrap the end portions of a single wire around the supporting members 27 and 28 and to set the tension in a variable fashion by rotating the supporting members 27 and 28.

Figure 3:
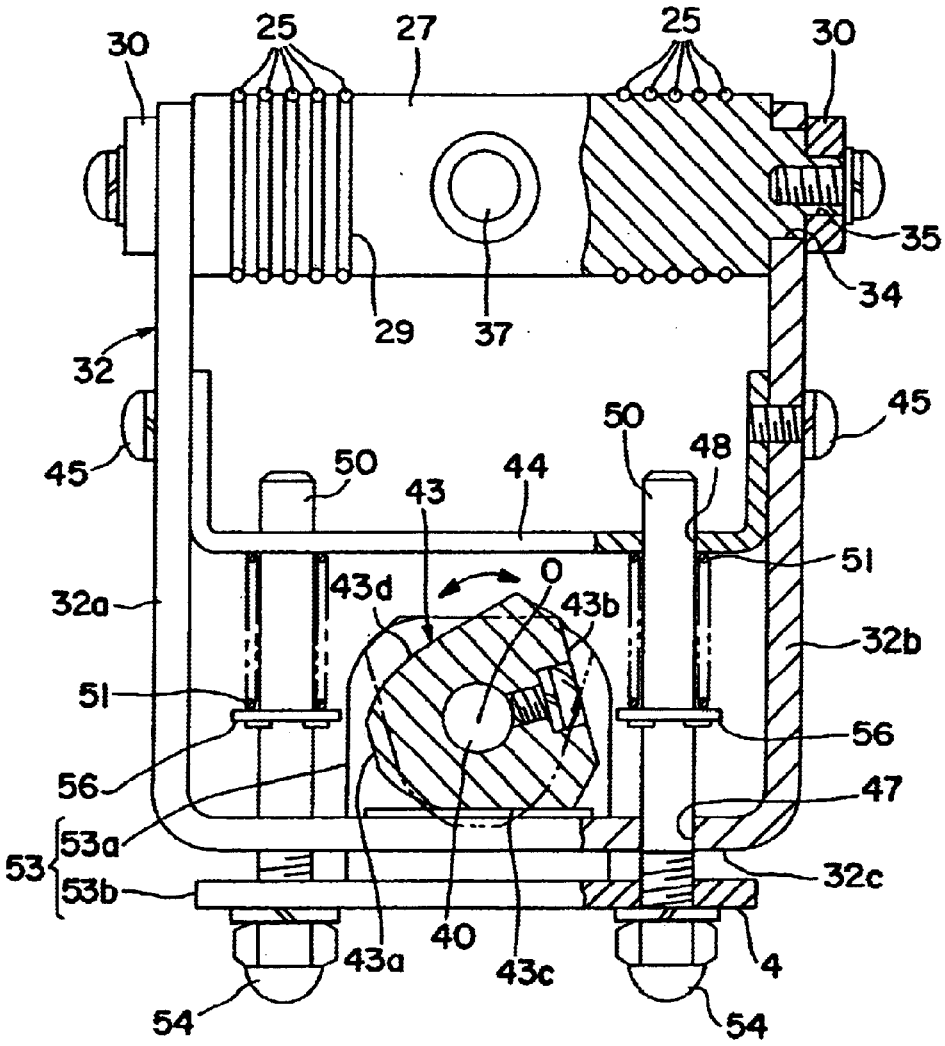
FIG. 3 is an enlarged sectional view taken along the line 3—3 in FIG. 1, showing the ON state of the acoustic wire.
Figure 4:
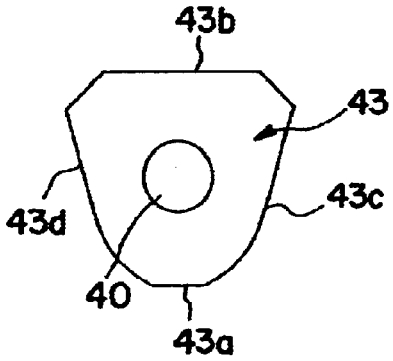
FIG. 4 shows the cam used in the drum, showing the OFF state of the acoustic wire.

As shown in FIGS. 1, 3 and 4, the first drawing mechanism 24 includes a rotating shaft 40 that is installed inside the trunk main body 11. This rotating shaft 40 is installed beneath the drum acoustic wire 22 so that it is parallel to the wire 22. Both ends of the rotating shaft 40 are rotatably supported by bearings 41 installed in the trunk main body 11 of the drum 10.

One end of the rotating shaft 40 protrudes to the outside of the trunk main body 11, and a handle 42 is attached to this protruding end. The handle 42 is moved as shown by arrow B so as to cause the drum acoustic wire 22 to contact and move away from the undersurface of the top side drum head 12 from the outside.

Furthermore, a pair of cams 43 are respectively installed on the rotating shaft 40 in opposing positions near the bearings 41. These cams convert the rotating motion of the rotating shaft 40 into an up-and-down (in the axial direction of the cylindrical trunk main body 11) motion of the brackets 32. Each of the cams 43, both of them having the same shape, is in a trapezoidal shape of left-right symmetry, and the respective comer areas are cut away at an inclination, so that the cam 43 has four faces: an upper face 43*a*, a bottom face 43*b* and left and right inclined faces 43*c* and 43*d*. The upper face 43*a* and one of the inclined faces 43*c* (43*d*) form the cam surfaces.

When the drum acoustic wire 22 is in an ON position that is shown in FIG. 3 in which the wire is in contact with the drum head 12, one of the inclined faces 43*c* (or 43*d*) is in contact with the bracket 32. When the drum acoustic wire 22 is brought to an OFF position in which the wire is not in contact with the drum head 12, the upper surface 43*a* is not in contact with the bracket 32. The distance from the center of rotation O (see FIG. 3) of the cam 43 to the upper face 43*a* is set to be greater than the distance from the center of rotation O to the inclined face 43*c*.

Each of the brackets 32 is formed in a U shape so as to open upward. The bracket 32 is comprised of a pair of left and right side plates 32*a* and 32*b* that are oriented parallel to each other on both sides of the cam 43 and a bottom plate 32*c* that is positioned beneath the cam 43 and connects the lower ends of the side plates 32*a* and 32*b*. Furthermore, a guide plate 44 which faces the bottom plate 32*c* with the cam 43 interposed is fastened between the side plates 32*a* and 32*b* by set screws 45. The bracket 32 is supported so as to be moved upward and downward (or in the axial direction of the main body 11) by being guided by a pair of left and right guide pins 50. These guide pins 50 pass through through-holes 47 and 48 formed in the bottom plate 32*c* and guide plate 44 and is driven upward by compression coil springs 51.

More specifically, the guide pins 50 are attached to an attachment plate 53. The attachment plate 53 is, as best seen from FIG. 1, formed in an L shape so that it consists of a vertical plate 53*a* and a horizontal plate 53*b* (see FIG. 3). The vertical plate 53*a* is screw-fastened to the inside end surface of the bearing 41. The horizontal plate 53*b* is positioned at an appropriate spacing beneath the bracket 32, and the pair of guide pins 50 are vertically installed in this horizontal plate 53*b*. Extemally-threaded screws are formed on the lower end portions of the guide pins 50; and these externally threaded screws are engaged with screw holes formed in the horizontal plate 53*b* and fastened in place by cap nuts 54.

The compression coil springs 51 are mounted on the guide pins 50. The upper ends of the springs are pressed against the undersurface of the guide plate 44, and the lower ends of the springs are pressed against check rings 56 attached to intermediate portions of the guide pins 50. Thus, the compression coil springs 51 keep the bracket 32 driven upward.

In the drawing mechanism 24 described above, the cams 43 are kept on their sides as shown in FIG. 3 when the drum acoustic wire 22 is in its ON state in which the acoustic wires 25 are in contact with the top side drum head 12. In this state, the brackets 32 are pushed upward by the spring force of the compression coil springs 51 so that the bottom plates 32*c* are pressed against the inclined surfaces 43*c* of the cams 43. When the cams 43 are rotated via the rotating shaft 40 by a specified angle (e.g., 75°) in the counterclockwise direction in FIG. 3 by way of the handle 42, the cams 43 are brought so as to stand upright as shown in FIG. 4 and press against the bottom plates 32*c*. As a result, the brackets 32 are pushed downward against the force of the compression coil springs 51, and the acoustic wires 25 are moved away from and separated from the top side drum head 12. Thus, the ON state of the acoustic wire is turned into its OFF state.

In FIG. 1, a second drum acoustic wire 60 is provided on the trunk main body 11. The second drum acoustic wire 60 is caused to contact and move away from the surface of the under side drum head 13. This is done by a second drawing mechanism 61. Like the first drum acoustic wire 22 shown in FIG. 2, this second drum acoustic wire 60 is also formed by stringing a single long wire 26 in a plurality of turns between a pair of supporting members (described below), so that the drum acoustic wire 60 is formed by a plurality of acoustic wires of a single continuous strand.

Figure 5A:
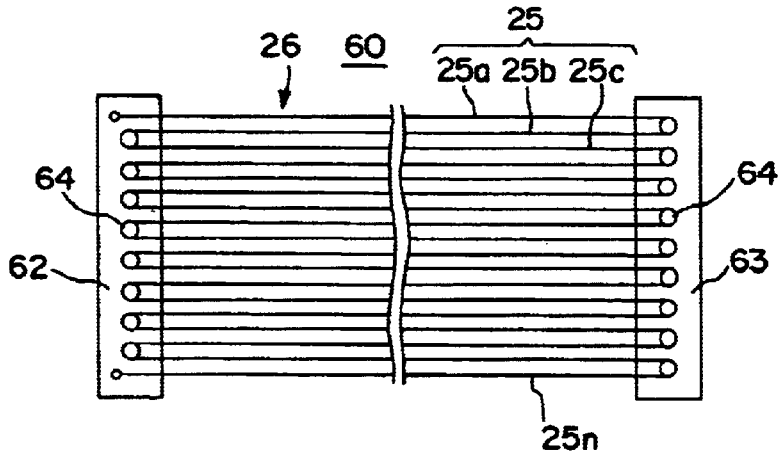
FIGS. 5(*a*) and 5(*b*) are top views of other configurations of acoustic wires according to the present invention.
Figure 5B:
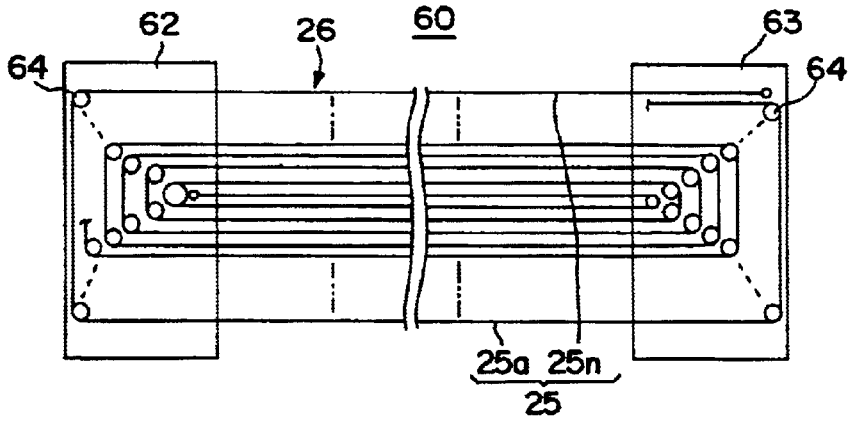
Figure 6:
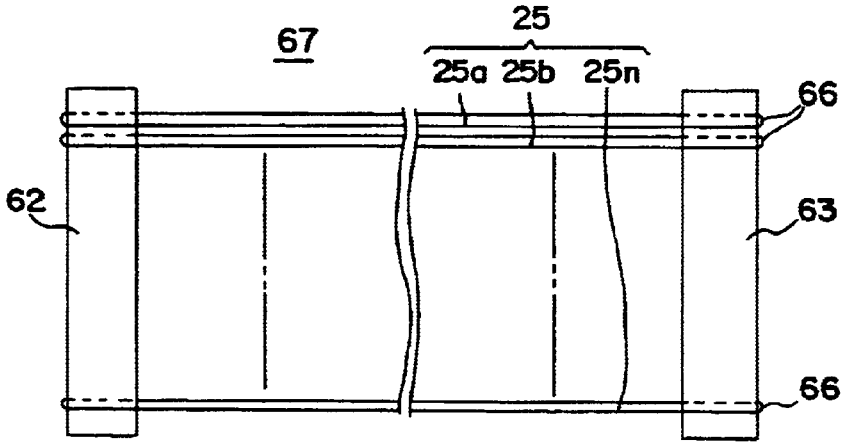
FIG. 6 shows still another configuration of the acoustic wire according to the present invention.
Figure 7:
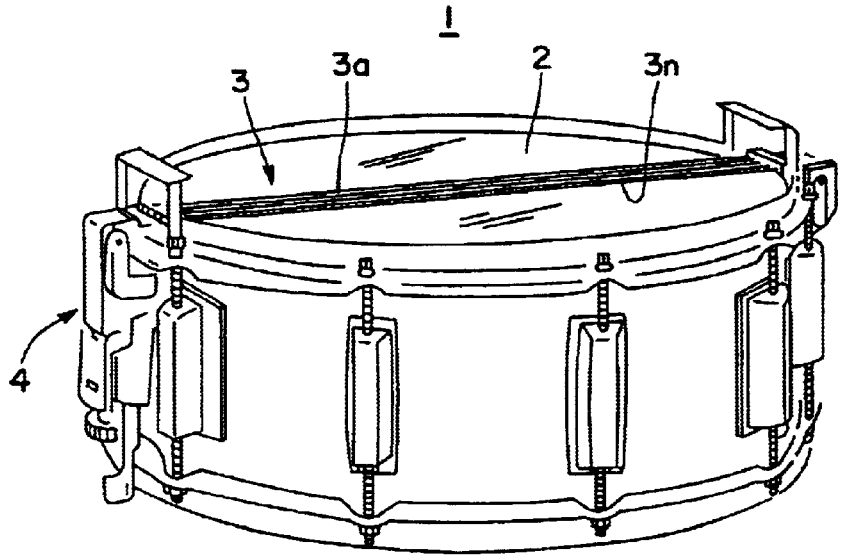
FIG. 7 PRIOR ART
FIG. 7 is a perspective view of a conventional snare drum with an acoustic wire installed.

Examples of the second drum acoustic wire are shown in FIGS. 5(*a*) and 5(*b*) and FIG. 6.

In the acoustic wire 60 of FIG. 5(*a*), a plurality of rotatable rollers 64 are spacedly installed on a pair of left and right plate-form supporting members 62 and 63 along the length of these supporting members, a single long wire 26 is alternately strung between these rollers 64, thus forming a plurality of acoustic wires 25*a* through 25*n* (i.e., the portions of the wire positioned between the left and right rollers 64) which are of a single continuous strand, and both ends of the wire 26 are fixed to one of the supporting members 62. Rollers having a diameter of approximately 6 mm are used in this example.

In the acoustic wire 60 of FIG. 5(*b*), a plurality of rotatable rollers 64 are installed in a V-shaped arrangement on a pair of left and right supporting members 62 and 63, a single wire 26 is strung around these rollers 64 in a spiral configuration so that a plurality of acoustic wires 25*a* through 25*n* form a single continuous strand, and both ends of the wire 26 are fastened to the respective supporting members 62 and 63.

FIG. 6 shows still another example of the drum acoustic wire.

In this drum acoustic wire 67, both ends of each one of a plurality of wires 66 formed as ring-shaped wires are strung between a pair of left and right supporting members 62 and 63 at a fixed spacing so that a plurality of acoustic wires 25*a* through 25*n* are formed. With the ring-form wires 66 installed between the supporting members 62 and 63, half of each wire 25 which is positioned on the top sides of the supporting members 62 and 63 forms an acoustic wire, while the remaining half of each wire which is positioned on the under sides of the supporting members 62 and 63 forms an excess length portion of the acoustic wire 25.

In FIG. 6, the ring-form wires 66 are strung between the supporting members 62 and 63. However, it is possible to install rollers 64 on the supporting members 62 and 63 as in the examples of FIGS. 5(*a*) and 5(*b*) and install ring-form wires 66 between these rollers 64.

As seen from FIG. 1, the second drawing mechanism 61 comprises a first holder 70 and a second holder 71. The first holder 70 is provided on the outer surface of the trunk main body 11 so that the height of the first holder 70 can be adjusted. The second holder 71 is provided at a position that is shifted by 180° in the circumferential direction from the first holder 70 on the outer surface of the trunk main body 11. One of the supporting members 62 of the second drum acoustic wire 60 is connected to the first holder 70. A movable base 74 which is moved in the axial direction of the trunk main body 11 by a lever 73 is installed on the second holder 71, and the other supporting member 63 of the second drum acoustic wire 60 is attached to this movable base 74. When the movable base 74 is moved up and down in FIG. 1 by the lever 73, the second drum acoustic wire 60 contacts and moves away from the surface of the under side drum head 13.

As seen from the above, when the first and second drawing mechanisms 24 and 61 are operated, the first and second drum acoustic wires 22 and 60 are independently caused to make a contact with and to move away from the top side drum head 12 and under side drum head 13, respectively. Thus, the tone color of the drum can be changed.

Figure 8A:
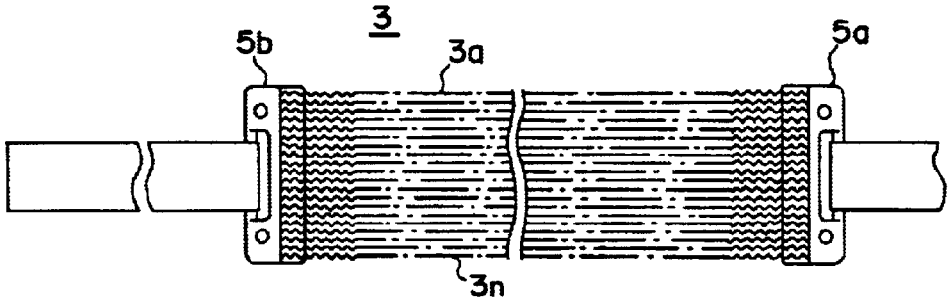
FIG. 8(a) PRIOR ART
FIGS. 8(*a*) and 8(*b*) show conventional acoustic wires.
Figure 8B:
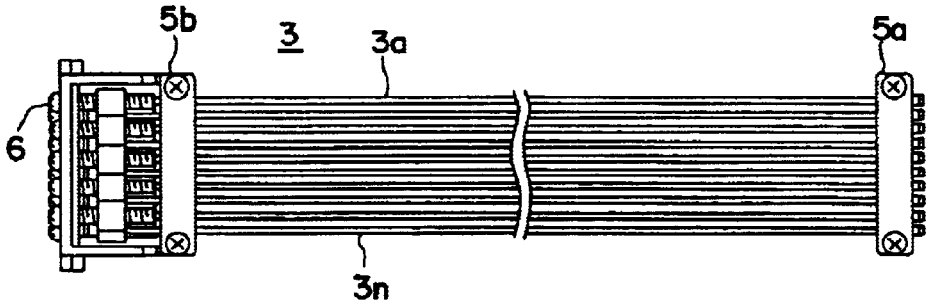
FIG. 8(b) PRIOR ART

In the drum acoustic wires 22 and 60 shown in FIGS. 2 through 5(*b*), a plurality of acoustic wires 25*a* through 25*n* are formed by stringing a single long wire 26 in a plurality of turns between the pair of supporting members 27 and 28. Consequently, the portions of the wires that are not directly in contact with the drum heads form excess length portions of the acoustic wires 25*a* through 25*n* and substantially increase the lengths of the acoustic wires 25*a* through 25*n*. Accordingly, compared to the conventional independent acoustic wires 3*a* through 3*n* shown in FIG. 8, the attenuation of the vibration is long, and the sound resonates well. Furthermore, the quantity of the sound is large, so that a drum with acoustic characteristics differing from those of conventional drums can be obtained.

Furthermore, in the present invention, it is only necessary to fasten both ends of the wire 26 to the supporting member(s) 27 and/or 28. Thus, the stringing of the wire 26 is easy, and no excessive load is applied to the acoustic wires 25*a* through 25*n*. Furthermore, when the supporting members 27 and 28 are moved and positioned closer to each other and moved away from each other, the acoustic wires 25*a* through 25*n* are adjusted to the length for a desired acoustic effect. Moreover, since the tension can be simultaneously and uniformly adjusted for all of the acoustic wires 25*a* through 25*n*, the tension adjustment work can be done easily.

In the drum acoustic wire 67 shown in FIG. 6, the ring-form wires 66 are strung around the pair of supporting members 62 and 63, and two acoustic wires 25*a* and 25*b*, 25*c* and 25*d* and so on, overlap above and below. Thus, a superimposition of the upper and lower vibrations occurs. As a result, the sound produced has a feeling of depth. Furthermore, since wires with a length that is twice that of conventional wires are used, the attenuation time of the vibration is also lengthened.

In the above embodiments, the first and second drum acoustic wires 22 and 60 are mounted on the top side and under side drum heads 12 and 13, respectively. However, the present invention is not limited to such configurations. It is possible to mount the first drum acoustic wire 22, which is described to be mounted on the top side drum head, on the under side drum head 13, and to mount the second drum acoustic wire 60 or 67, which is described to be mounted on the under side drum head, on the top side drum head 13. It is also possible to use either one of the first drum acoustic wire 22 or the second drum acoustic wire 60 (67) on either the top or under side drum head. It is further possible to mount the first drum acoustic wire 22 on the top side drum head 12 and to mount a drum acoustic wire of the conventional type shown in FIG. 8 on the under side drum head 13.

As seen from the above, according to the present invention, acoustic wires are formed by a single long wire, and these acoustic wires form a single continuous strand. Accordingly, a long vibration attenuation time and a large sound quantity are obtained, and acoustic characteristics that differ from those of conventional drum acoustic wires is also obtained.

Furthermore, the installation of the acoustic wires to the supporting members and the tension adjustment work of the wires can be done easily, and all the acoustic wires can be adjusted to a uniform tension.

What is claimed is:

1. A drum acoustic wire alternately caused to contact and move away from a surface of a drum head which is stretched over an opening of a drum body of the drum, wherein a pair of supporting members are each disposed on diametrically opposite sides of said drum body; and said acoustic wire is formed by a single continuous long wire that is bent and strung in a plurality of turn between said pair of supporting members so as to be continuous as a single strand; and said wire extends half a turn at a time around circumferential surfaces of each of said supporting members.

2. A drum acoustic wire according to claim 1, wherein bent portions of said wire are supported by said supporting members so as to be slidable on said supporting members.

3. A drum acoustic wire alternately caused to contact and move away from a surface of a drum head which is stretched over an opening of a drum body of the drum, wherein said acoustic wire is formed by a single continuous long wire that is strung in a plurality of ring-form wires between a pair of supporting members.

4. A drum acoustic wire according to claim 1, further comprising an adjustment mechanism which adjusts tension of said acoustic wire.

5. A drum acoustic wire according to claim 2, further comprising an adjustment mechanism which adjusts tension of said acoustic wire.

6. A drum acoustic wire according to claim 3, further comprising an adjustment mechanism which adjusts tension of said acoustic wire.

7. A drum that is equipped with a drum acoustic wire alternately caused to contact and move away from a surface of a drum head which is stretched over an opening of a drum body of said drum, said acoustic wire being formed by a single continuous long wire that is bent and strung in a plurality of turns between a pair of supporting members so as to be continuous as a single strand; and wherein said wire extends half a turn at a time around circumferential surfaces of each of said supporting members.

8. A drum according to claim 7, wherein bent portions of said wire are supported by said supporting members so as to be slidable on said supporting members.

9. A drum that is equipped with a drum acoustic wire alternately caused to contact and move away from an interior side of a drum head of said drum, said acoustic wire being formed by a single continuous long wire that is strung in a plurality of ring-form wires between a pair of supporting member.

10. A drum according to claim 7, further comprising an adjustment mechanism which adjusts tension of said acoustic wire.

11. A drum according to claim 8, further comprising an adjustment mechanism which adjust tension of said acoustic wire.

12. A drum according to claim 9, further comprising an adjustment mechanism which adjusts tension of said acoustic wire.

13. A drum including an acoustic wire which is alternately caused to contact and move away from an interior side of a drum head of said drum, wherein said acoustic wire is comprised of a single continuous wire that is strung in a plurality of turns between a pair of supporting members provided on diametrically opposite inner sides of a cylindrical drum body of said drum, thus forming acoustic wires that are disposed parallel to each other.

14. The drum acoustic wire according to claim 2 wherein each of said pair of supporting members comprises a single round post disposed parallel to said drum head.

15. A drum acoustic wire alternately caused to contact and move away from a surface of a drum head which is stretched over an opening of a drum body of the drum, wherein a pair of supporting members are each disposed on diametrically opposite sides of said drum body, a plurality of pairs of rollers are provided on said supporting members; and said acoustic wire is formed by a single continuous long wire that is bent and strung in a plurality of turns between said pair of rollers so as to be continuous as a single strand.

* * * * *